United States Patent [19]

Egerer

[11] Patent Number: 4,606,095

[45] Date of Patent: Aug. 19, 1986

[54] SAW-TOOTHED STAMPED METAL PART AS OUTFIT FOR A COMB SEGMENT OF A PORCUPINE

[75] Inventor: Josef Egerer, Schwabach, Fed. Rep. of Germany

[73] Assignee: Staedtler & Uhl, Fed. Rep. of Germany

[21] Appl. No.: 776,844

[22] Filed: Sep. 17, 1985

[30] Foreign Application Priority Data

Oct. 18, 1984 [DE] Fed. Rep. of Germany ... 8430562[U]

[51] Int. Cl.[4] ..... D01G 19/10; D01G 15/14

[52] U.S. Cl. ..... 19/97; 19/112; 19/114

[58] Field of Search ..... 19/97, 112, 113, 114

[56] References Cited

U.S. PATENT DOCUMENTS

| | | | |
|---|---|---|---|
| 2,731,676 | 1/1956 | Apthorp et al. | 19/114 |
| 3,646,639 | 3/1972 | Burckhardt et al. | 19/97 |
| 4,394,789 | 7/1983 | Egerer | 19/97 |

FOREIGN PATENT DOCUMENTS

| | | | |
|---|---|---|---|
| 0721950 | 12/1931 | France | 19/114 |

*Primary Examiner*—Louis K. Rimrodt

*Attorney, Agent, or Firm*—Laff, Whitesel, Conte & Saret

[57] ABSTRACT

Saw toothed metal parts as outfits for comb segment of a porcupine for textile machines such as combing machines in which each metal part has a stilt functioning as the holding component in the comb segment and a plurality of teeth extending outwardly from the stilt, the said teeth being inclined in pointed angle to the radial direction of the comb segment in the direction of rotation of the comb segment, the height of the centers of the teeth increasing in the direction of rotation. The angle of action that is the angle between the front face of a tooth and the radius passing through the tip of the tooth, as well as the distance between the centers of the teeth increase in the direction of rotation of the comb segment.

7 Claims, 2 Drawing Figures

SAW-TOOTHED STAMPED METAL PART AS OUTFIT FOR A COMB SEGMENT OF A PORCUPINE

This invention relates to a saw-toothed stamped metal part as outfit for a comb segment of a porcupine for textile machines, specially combing machines.

Such a type of stamped metal part is disclosed in U.S. Pat. No. 4,394,789.

BACKGROUND OF THE INVENTION

Such stamped metal parts have the advantage compared to a previously used spiral type saw-toothed outfit wherein only a low cost is necessary for a renewal of the outfit which may become necessary in the course of the operation. This means, the user can insert a new outfit himself without setting the roller or comb segments for a special operation. With these stamped metal parts great economical advantages are therefore achieved, as the service lives of the machines are kept short and the working cost is low.

Affected by the technical development mentioned earlier, which was based on an endless "saw-toothed wire", which was pulled round the porcupine, the experts started from the fact that even the saw-toothed stamped metal parts used among each other must have been formed adequately just as the teeth of each single stamped metal part.

This invention has in principle the object that the combing effect can still be improved considerably by the fact that different stamped metal parts, seen in the direction of rotation or within a stamped metal part, different formation of teeth are used.

SUMMARY OF THE INVENTION

Corresponding to that the basic purpose of this invention is to develop a saw-toothed stamped metal part in such a way that the quality of the combing is improved and the production, i.e., the material throughout is increased.

This problem is solved according to this invention by forming a plurality of outwardly extending teeth on the said stamped metal part, the teeth being inclined in pointed angle to the radial direction of the comb segment in the direction of rotation, the height of the centers of the teeth increasing in the direction of rotation. By the change of the height of centers provided according to our invention, the tuft is completely penetrated during the entrance of the teeth into the tuft as seen at the front in the direction of rotation, and is drawn in, in upto the bottom of the porcupine, and this was not achieved by the known art in which case a part of the fibers could not be penetrated or could not be sufficiently penetrated because of uniform tip projection and thus the tuft was combed imperfectly. By the shaping of the teeth according to this invention the increase in production of upto 30% is achieved against a conventional saw-toothed outfit, as has been proved by the tests.

The distance between centers of the radial distance of the cuts remaining constant between the teeth with reference to the turning center point is defined as the height of centers for the purpose in this case. In other words a higher height of centers is of the same importance with a longer distance between centers from the turning center point of the porcupine in the assembled state.

One further advantageous shaping of the teeth is the increase in the angles of inclination of the successive teeth in the direction of rotation. The penetration of the teeth into the tuft is eased by the more sharp angles of action thus provided at the front part of the saw-toothed stamped metal part as seen in the direction of rotation. Heresuch a soft and light penetration is of considerable importance to achieve a jerkless work cycle of rotation which protects the material.

The angle between the front flank of each tooth and the imaginary connection of the corresponding tip of a tooth with the turning center point is defined as the angle of action in this case.

The shaping of the teeth to increase the distance between the centers or tips of the teeth in the direction of rotation also eases the penetration into the tuft. Accordingly the height of centers is provided greater at the front as seen in the direction of rotation.

Thus, an improved combing effect is achieved as a whole. Although it is assured that also a cleaning brush can function effectively, the brush cleans the combing roller only after each combing interval. The function of the cleaning brush is assured specially by the relatively low height of centers at the rear ends as seen in the direction of rotation. In this case the cleaning brush can also penetrate easily.

A comb segment according to our invention also makes it possible to match the front row, which is specially important for the penetration into the tuft by saw-toothed stamped metal parts with the saw-toothed shaping and optimum dimensionizing as per requirements because the segments equipped in the known methods can only be used for the following rows.

The arrangement of saw-toothed stamped metal parts within the row of a comb segment or the shaping of the same brings along a displacement of the tips. This displacement has proved itself to be advantageous. It can be designed according to the requirements but in a specially simple way corresponding to a desired configuration.

The progressive decrease of height of centers of the teeth and in a preferable way also the reduction of the angle of action and the height of the centers continue over the whole comb angle of the comb segment of 130°, for example. The same technical effect can be achieved by means of shaping the stamped metal parts as described hereinafter. In this case not just only one row of the stamped metal parts, from which each one stretches over a relatively wide range of angle, but several rows designed one after another are provided, so that in total a progressive reduction of the characteristic magnitude is achieved against the direction of rotation.

BRIEF DESCRIPTION OF THE DRAWINGS

The further characteristics, advantages and details of this invention will be found from the following description of a preferred embodiment illustrated in the accompanying drawings, in which.

DESCRIPTION OF A PREFERRED EMBODIMENT

Figure 1:
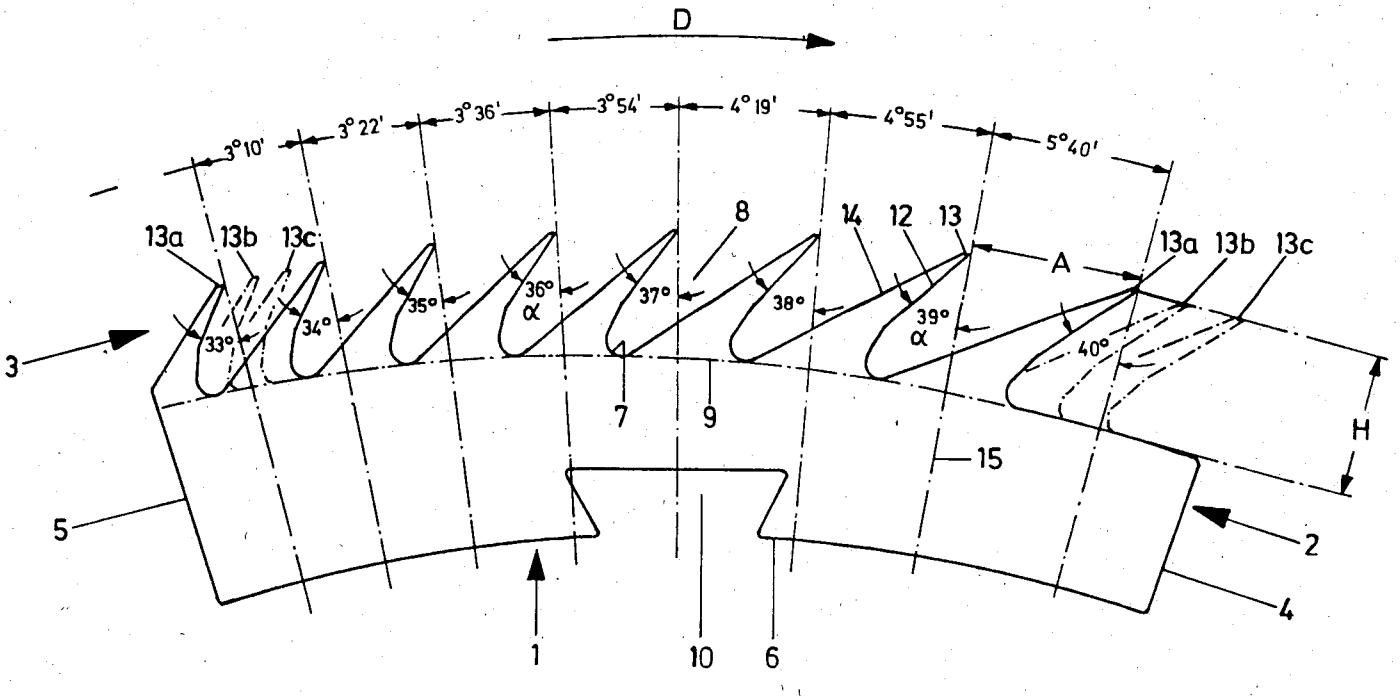
FIG. 1: shows a front elevation of a saw-toothed stamped metal part according to this invention; and, FIG. 2: shows a sectional view of a comb segment, including various rows of saw-toothed stamped metal parts as seen from the front side thereof.

A saw-toothed stamped metal part 1 according to this invention is shown in FIG. 1 which includes a stilt 2 and a number of teeth 3 formed on it.

The stilt 2 is terminated by two radially running side edges 4 and 5, a running low edge 6 shaped like a circular section and an upper edge 9 defined by the joining lines of the lowest points 7 of the cuts 8 formed between the teeth 3.

The stilt 2 has a recess 10 of dove tail shape. This recess functions to fit the stamped metal part on a corresponding dove tail guide of a comb segment. However, any other fixing arrangement for the same is also possible considering the shaping of the stamped metal part according to this invention, e.g., sidewise insertion of the stilt and securing it by means of cementing, and the like.

Every tooth 3 has a front face 12, a tip 3 and a rear face 14. For describing the shape of the tooth, the height of centers H is defined as the distance of the tips 13 from the upper edge 9 of the stilt 2. This height is proportional to the distance of the tips 13 from the center of rotation M in the assembled state of the stamped metal part 1 (not shown in FIG. 1). The angle between the front face 12 of a tooth 3 and the radius going through the concerned tip 13 with reference to the center of rotation in the assembled state is defined as the angle of action $\alpha$. The distance A between the tips 13 of two adjacent teeth 3 is defined as the distance between the centers. A stamped metal part 1 according to this invention is thus shaped in such a way that the height of centers H, the distance between the centers A and the angle of action $\alpha$ increase in the direction of rotation D from one tooth 3 to the next tooth 3. The increase of the said three parameters results preferably in a uniform progressive manner but can also vary in steps.

Due to the shaping of the teeth described above, a soft and deep penetration of the stamped metal part into the tuft is achieved. The tuft is completely penetrated and yet the effectiveness of the cleaning brushes is not impaired. By this process it is possible to achieve a considerable increase of production due to the outfit being easily exchangable or replaceable and due to uniform and low abrasion during the operation of the machine.

Figure 2:
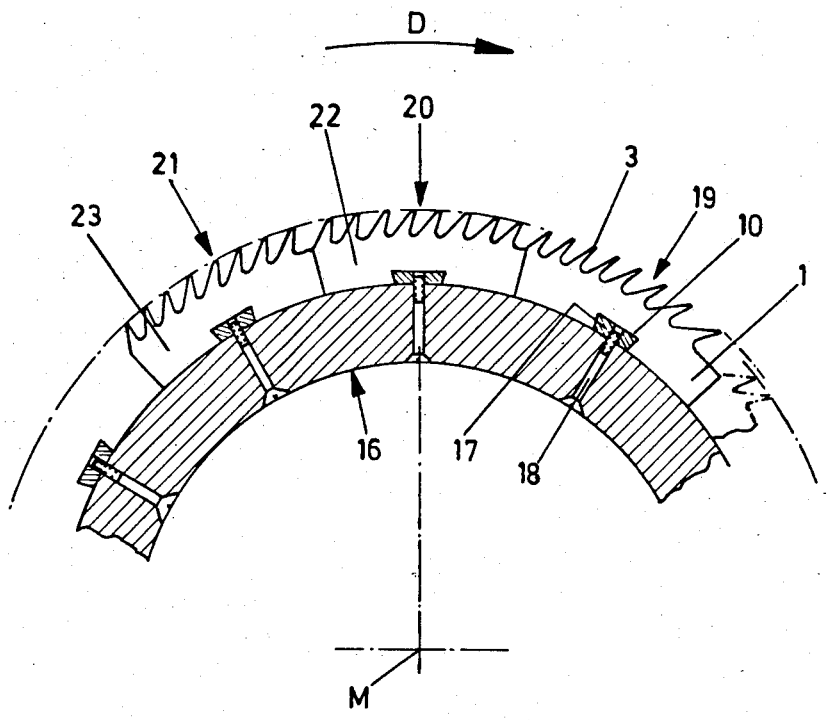

In FIG. 2 is illustrated how the saw-toothed stamped metal parts 1 according to this invention can be fitted on a comb segment 16. In the form of construction illustrated by way of example in FIG. 2, a first row 19 of the stamped metal part 1 is lined up on a retaining strip 17 having a dove tail profile. This retaining strip is fixed by means of a screw 18 on the comb segment 16. These stamped metal parts 1 along with the recesses 10 are pushed upon the retaining strip 17. The teeth 3 of the stamped metal parts 1 according to this invention and illustrated in FIG. 2 are shaped as those indicated and described in detail with reference to FIG. 1.

Seen against the direction of rotation D, a second row 20 of stamped metal parts 22 link up with the first row 19 and a third row 21 of the stamped metal parts 23. The stamped metal parts 22 and 23 are actually made by a well known process, i.e., they have teeth with the height of centers remaining same, with the same angle of action $\alpha$ and the distance between the centers remaining constant. The series of stamped metal parts 22 and 23 are fixed in the corresponding manner on the comb segment 16 as the first row 19 of the stamped metal parts 1. The center of rotation M of the comb segment 16 is marked only in FIG. 2. The advantages according to this invention are achieved by the use of the stamped metal parts 1 even only for the first row 19, seen in the direction of rotation, first penetrating the tuft during the rotation of the comb. Then in this case even the following rows 20, 21 also display a good comb effect, if they are shaped according to the known manner.

One more possible variation, according to this invention, is illustrated in FIG. 1 by dotted or dot and dash lines. Here the stamped metal parts with different angles of action $\alpha$ are chosen for the line-up of a series of stamped metal parts 1, so that the tips of the stamped metal parts 1 in one row are bunched in axial direction against each other. This has been illustrated in FIG. 1 with the help of the tips 13*a*, 13*b* and 13*c*.

In order to realise mass production of the specially advantageous shaping of a stamped metal part 1, the distance between the centers A in degrees of angle and the angle of action are shown in FIG. 1. The increase of height of centers H from the last tooth 3 upto the first tooth 3, seen in the direction of rotation D, is in that case about 50% with reference to the height of centers H of the last tooth 3, seen in the direction of rotation.

We claim:

1. A saw-toothed stamped metal part as outfit for a comb segment of a porcupine for textile machines, specially combing machines, comprising a stilt functioning as the holding component in the comb segment and a plurality of outwardly extending teeth formed on the said stilt being inclined in pointed angle to the radial direction of the comb segment in the direction of rotation, wherein the height of centers increases in the direction of rotation.

2. The saw-toothed stamped metal part as claimed in claim 1, wherein the angle of action increases when seen in the direction of rotation.

3. The saw-toothed stamped metal part as claimed in claim 1, wherein the distance between the centers increases when seen in the direction of rotation.

4. A comb segment with a saw-toothed stamped metal part as claimed in claim 1, wherein the several rows of stamped metal parts are coordinated directly with each other and successively one after another, in which the first row of the stamped metal parts, seen in the direction of rotation is provided with teeth changing progressively in the direction of rotation, whereas the following rows of the stamped metal parts have teeth which are formed identical with each other.

5. The comb segment as claimed in claim 4, wherein the stamped metal parts are coordinated with distance between centers differently from each other and the angles of action in the metal parts arranged side by side within a row are different.

6. The comb segment with a saw-toothed stamped metal part as claimed in claim 1, wherein a series of stamped metals parts stretches over the whole comb angle.

7. The comb segment with a saw-toothed stamped metal part as claimed in claim 1, wherein several rows of stamped metal parts are coordinated directly with each other successively one after another, the stamped metal parts being dimensionized differently in the rows following the first row and provided in such a way that the stamped metal parts of the rows following the first have teeth, the changes in which are uniform and progressive.

* * * * *